US008155558B2

(12) United States Patent
Noh et al.

(10) Patent No.: US 8,155,558 B2
(45) Date of Patent: Apr. 10, 2012

(54) DEVELOPING CARTRIDGE, IMAGE FORMING APPARATUS HAVING THE SAME, AND PRINTING METHOD FOR AN IMAGE FORMING APPARATUS

(75) Inventors: Joo-Hwan Noh, Yongin-Si (KR); Jong-Moon Eun, Yongin-Si (KR); Jean-Man Sur, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 843 days.

(21) Appl. No.: 12/200,013

(22) Filed: Aug. 28, 2008

(65) Prior Publication Data

US 2009/0214227 A1 Aug. 27, 2009

(30) Foreign Application Priority Data

Feb. 22, 2008 (KR) ..... 10-2008-0016459

(51) Int. Cl.
*G03G 15/04* (2006.01)

(52) U.S. Cl. ..... 399/119; 399/110; 399/13

(58) Field of Classification Search ..... 399/13, 399/110, 119, 111
See application file for complete search history.

(56) References Cited

U.S. PATENT DOCUMENTS

| | | | |
|---|---|---|---|
| 4,967,234 | A | 10/1990 | Tani et al. |
| 4,974,020 | A | 11/1990 | Takamatsu et al. |
| 4,977,429 | A | 12/1990 | Tani et al. |
| 5,479,247 | A | 12/1995 | Watanabe et al. |
| 5,493,366 | A | 2/1996 | Satoh et al. |
| 5,499,077 | A | 3/1996 | Endo et al. |
| 5,589,915 | A | 12/1996 | Hashimoto |
| 5,960,238 | A | 9/1999 | Ohgami |
| 6,041,212 | A | 3/2000 | Okada |
| 6,104,888 | A | 8/2000 | Kobayashi |
| 6,151,459 | A | 11/2000 | Hashimoto et al. |
| 6,792,230 | B2 | 9/2004 | Saito et al. |
| 6,980,758 | B2 | 12/2005 | Murayama et al. |
| 7,340,197 | B2 | 3/2008 | Murayama et al. |
| 2002/0085857 | A1 | 7/2002 | Kim et al. |
| 2002/0085887 | A1 | 7/2002 | Schneider et al. |
| 2003/0161653 | A1 | 8/2003 | Ban et al. |
| 2004/0001723 | A1 | 1/2004 | Ashida et al. |
| 2004/0223772 | A1 | 11/2004 | Nakazato |
| 2005/0047821 | A1 | 3/2005 | Murayama et al. |

(Continued)

FOREIGN PATENT DOCUMENTS

| | | | |
|---|---|---|---|
| EP | 0 570 993 | A1 | 11/1993 |

(Continued)

OTHER PUBLICATIONS

Office Action issued in Russian patent application No. 2008148636, mailed Oct. 28, 2009.

(Continued)

*Primary Examiner* — David Gray
*Assistant Examiner* — Roy Y Yi
(74) *Attorney, Agent, or Firm* — Stanzione & Kim, LLP

(57) ABSTRACT

A developing cartridge usable with an image forming apparatus includes a housing having a developing member, a developer storing portion storing developer supplied to the developing member, and a mounting portion allowing at least one developer cartridge storing supplementary developer to be detachably mounted. Printing operations can be performed using the developer available in the developer-storing portion even in the absence of a developer cartridge.

39 Claims, 8 Drawing Sheets

U.S. PATENT DOCUMENTS

| | | | | |
|---|---|---|---|---|
| 2005/0095020 | A1 | 5/2005 | Eom et al. | |
| 2005/0238378 | A1* | 10/2005 | Fukaya | 399/85 |
| 2005/0254841 | A1* | 11/2005 | Tomitaka | 399/12 |
| 2005/0260011 | A1 | 11/2005 | Murayama et al. | |
| 2006/0210285 | A1 | 9/2006 | Nakazato | |
| 2006/0285880 | A1 | 12/2006 | Okabe | |
| 2007/0092270 | A1* | 4/2007 | Inukai | 399/13 |
| 2007/0230999 | A1 | 10/2007 | Shimomura | |
| 2008/0056772 | A1 | 3/2008 | Utsumi et al. | |

FOREIGN PATENT DOCUMENTS

| | | |
|---|---|---|
| EP | 0 672 971 | 9/1995 |
| EP | 1 548 519 | 6/2005 |
| EP | 1 840 671 | 10/2007 |
| EP | 1 881 378 | 1/2008 |
| IE | 1 437 632 | 7/2004 |
| JP | 60-238873 | 11/1985 |
| JP | 01-091164 | 4/1989 |
| JP | 09-022177 | 1/1997 |
| JP | 10-142910 | 5/1998 |
| JP | 11-24513 | 1/1999 |
| JP | 2000-75627 | 3/2000 |
| JP | 2000-075659 | 3/2000 |
| JP | 2004-264539 | 9/2004 |
| JP | 2005-326637 | 11/2005 |
| JP | 2005-338329 | 12/2005 |
| JP | 2007-025511 | 2/2007 |
| KR | 91-1489 | 1/1991 |
| KR | 10-2001-0061976 | 7/2001 |
| KR | 10-2005-0033796 | 4/2005 |
| KR | 10-2006-0034168 | 4/2006 |
| KR | 10-2006-0128338 | 12/2006 |
| RU | 2266553 | 4/2005 |

OTHER PUBLICATIONS

English language translation of Office Action issued in Russian patent application No. 2008148636, mailed Oct. 28, 2009.
English language abstract of JP 2000-075659, published Mar. 14, 2000.
Machine English language translation of JP 2000-075659, published Mar. 14, 2000.
English language abstract of RU 2289835, published Dec. 20, 2006.
European Search Report issued in EP 09 15 0144, issued Jan. 22, 2010.
English language abstract of JP 2004-264539, published Sep. 24, 2004.
Machine English language translation of JP 2004-264539, published Sep. 24, 2004.
Office Action issued in Russian patent application No. 2008148667, mailed Dec. 11, 2009.
English language translation of Office Action issued in Russian patent application No. 2008148667, mailed Dec. 11, 2009.
Notice of Allowance issued in Russian Application No. 2008148634, mailed Jan. 21, 2010.
Partial English language translation of Notice of Allowance issued in Russian Application No. 2008148634, mailed Jan. 21, 2010.
English language abstract of RU 2,266,553, published Apr. 20, 2005.
English language abstract of JP 2007-025511, published Feb. 1, 2007.
Machine English language translation of JP 2007-025511, published Feb. 1, 2007.
Korean Office Action issued in Application No. 10-2008-0016455, issued in Jan. 23, 2009.
English abstract of KR 10-2006-0128338, published Dec. 14, 2006.
English Language abstract of KR 91-1489, published Jan. 31, 1991.
Korean Office Action issued in Application No. 10-2008-0016464, mailed Feb. 6, 2009.
Korean Office Action issued in Application No. 10-2008-0016467, mailed Jan. 30, 2009.
English language abstract of KR 10-2006-0034168, published Apr. 21, 2006.
English language abstract of JP 09-022177, published Jan. 21, 1997.
Machine English language translation of JP 09-022177, published Jan. 21, 1997.
Korean Office Action issued in Application No. 10-2008-0016472, mailed Feb. 5, 2009.
English language abstract of KR 10-2005-0033796, published Apr. 13, 2005.
Korean Office Action issued in Application No. 10-2008-0016469, mailed Feb. 6, 2009.
English language abstract of KR 10-2001-0061976, published Jul. 7, 2001.
European Search Report issued in European Application No. 09 15 0141, mailed Apr. 14, 2009.
European Search Report issued in EP 09150067.8, mailed Jun. 3, 2009.
English language abstract of JP 60-238873, published Nov. 27, 1985.
English language abstract of JP 01-091164, published Apr. 10, 1989.
Office Action issued in KR 10-32008-0016469, mailed Jun. 3, 2009.
English language abstract of JP 2005-326637, mailed Nov. 24, 2005.
Machine English language translation of JP 2005-326637, mailed Nov. 24, 2005.
English language abstract of JP 2005-338329, published Dec. 8, 2005.
Machine English language translation of JP 2005-338329, published Dec. 8, 2005.
Machine English language translation of JP 10-142910, published May 29, 1998.
Machine English language translation of JP 11-24513, published Jan. 29, 1999.
Machine English language translation of JP 2000-75627, published Mar. 14, 2000.
European Search Report Issued in European Application No. 09 15 0066, mailed Jul. 29, 2009.
European Search Report issued in European Application No. 09 15 2590, mailed Aug. 17, 2009.
Examination Report issued in European Patent Application No. 09 150 141.1 on Jul. 21, 2011.

* cited by examiner

DEVELOPING CARTRIDGE, IMAGE FORMING APPARATUS HAVING THE SAME, AND PRINTING METHOD FOR AN IMAGE FORMING APPARATUS

CROSS-REFERENCE TO RELATED APPLICATIONS

This application claims the benefit under 35 U.S.C. §119 (a) from Korean Patent Application No. 2008-16459 filed Feb. 22, 2008 in the Korean Intellectual Property Office, the disclosure of which is incorporated herein by reference in its entirety.

BACKGROUND OF THE INVENTION

1. Field of the Invention

The present invention relates generally to an image forming apparatus. More particularly, to a developing cartridge usable with an image forming apparatus using, an image forming apparatus having the same, and a printing method of the image forming apparatus.

2. Description of the Related Art

Generally, electrophotographic image forming apparatuses, such as printers, facsimile machines, copy machines, multifunctional products, or the like, use developer to form images. The developer may be supplied within the image forming apparatus by a developing cartridge, which may be removably installed in the image forming apparatus.

The usable lifespan of the developing cartridge greatly affects the printing cost per page of the image forming apparatus. An integral type developing cartridge has a developer storing portion formed integrally with the developing cartridge, and can be used for performing printing operations during a predetermined lifespan corresponding to the amount of developer stored in the developer storing portion. If the size of the developer storing portion is large, the developing cartridge may be used for longer period of time than a developing cartridge with a smaller sized developer storing portion. A larger developer storing portion however increases the size of the developing cartridge, and in turn the size of the image forming apparatus.

A separable type developing cartridge with a removable developer cartridge may alleviate the need for frequent replacement of a developing cartridge without requiring a large developer storing portion. However, a separable type developing cartridge may be inoperable without the developer cartridge being installed.

BRIEF DESCRIPTION OF THE DRAWINGS

Various aspects and utilities of the embodiments of the present invention will become apparent and more readily appreciated from the following description of the embodiments, taken in conjunction with the accompanying drawings of which.

DETAILED DESCRIPTION OF SEVERAL EMBODIMENTS

Figure 1:
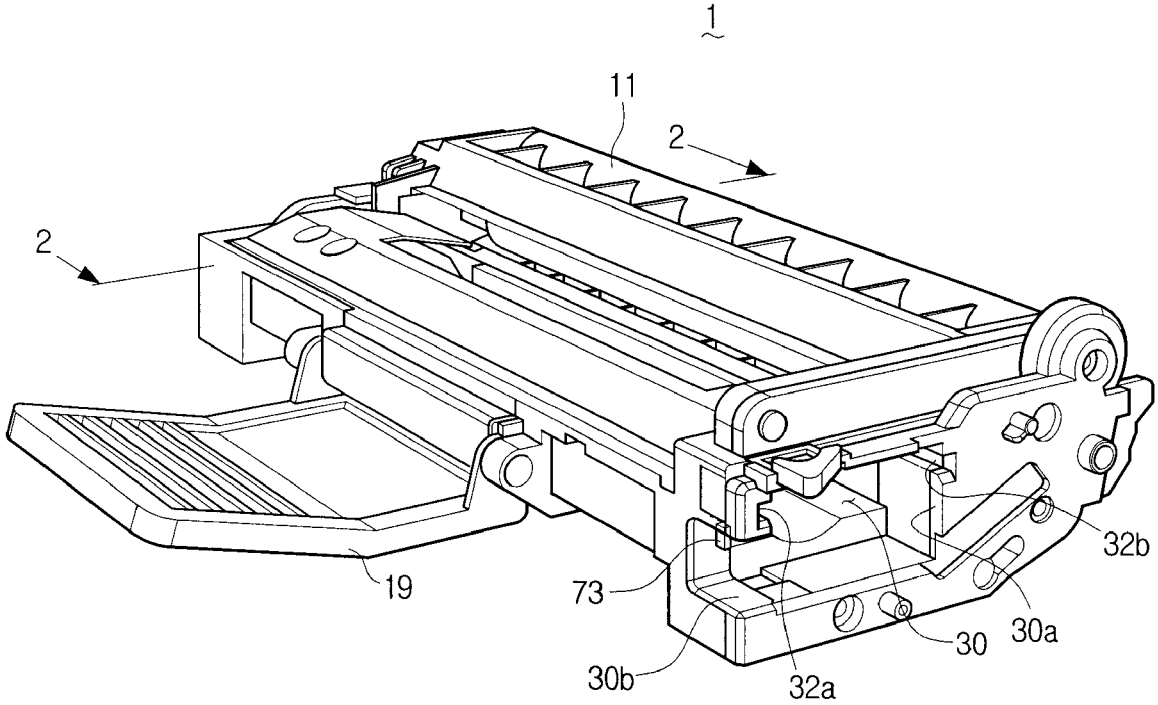
FIG. 1 is a perspective view illustrating a developing cartridge usable with an image forming apparatus according to an embodiment of the present invention.

Reference will now be made to the embodiments of the present invention, examples of which are illustrated in the accompanying drawings, wherein like reference numerals refer to the like elements throughout. The matters described herein, such as a detailed construction and elements thereof, are provided to assist in a comprehensive understanding of the embodiments, may not be all required to practice the various aspects of the present invention. Thus, it should be readily apparent that aspects of the present invention may be carried out without those details described herein. For the sake of brevity, and in order to avoid obscuring the description with unnecessary detail, well-known functions or constructions will not be described in detail.

Figure 2:
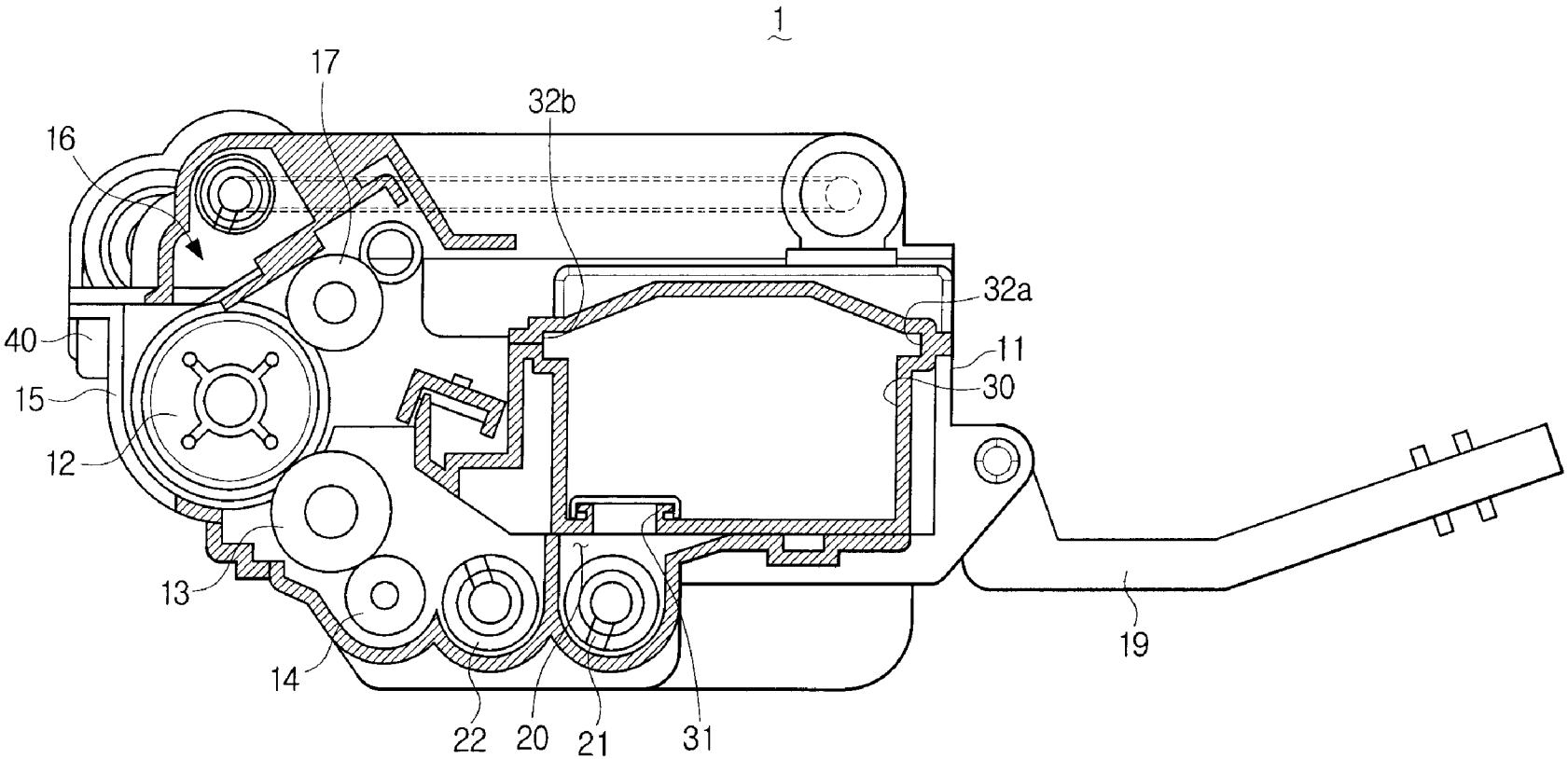
FIG. 2 is a sectional view illustrating the developing cartridge of FIG. 1 taken along the line 2-2 shown in FIG. 1.

FIG. 1 is a perspective view illustrating a developing cartridge 1 usable with an image forming apparatus according to an embodiment. FIG. 2 illustrates a sectional view of the developing cartridge 1 of FIG. 1 taken along a line 2-2 in FIG. 1.

Referring to FIGS. 1 and 2, the developing cartridge 1 may include a housing 11, an image carrier 12, a developing member 13, a developer-storing portion 20, and a mounting portion 30. The housing 11 forms the outer appearance of the developing cartridge 1 and may rotatably support the image carrier 12 and the developing member 13. A folding handle 19 may be disposed at a side of the housing 11. The folding handle 19 may be used when the developing cartridge 1 is mounted into and removed from the image forming apparatus 100 (see FIG. 3). A first mounting history indicating member 40 may be disposed at the front end of the housing 11. When the developing cartridge 1 is mounted into the image forming apparatus 100, a controller 170 (see FIG. 3) of the image forming apparatus 100 uses the first mounting history indicating member 40 of the developing cartridge 1 to determine whether the developing cartridge 1 mounted in there is a new one or a used one. For example, a fuse may be used as the first mounting history indicating member 40.

Figure 3:
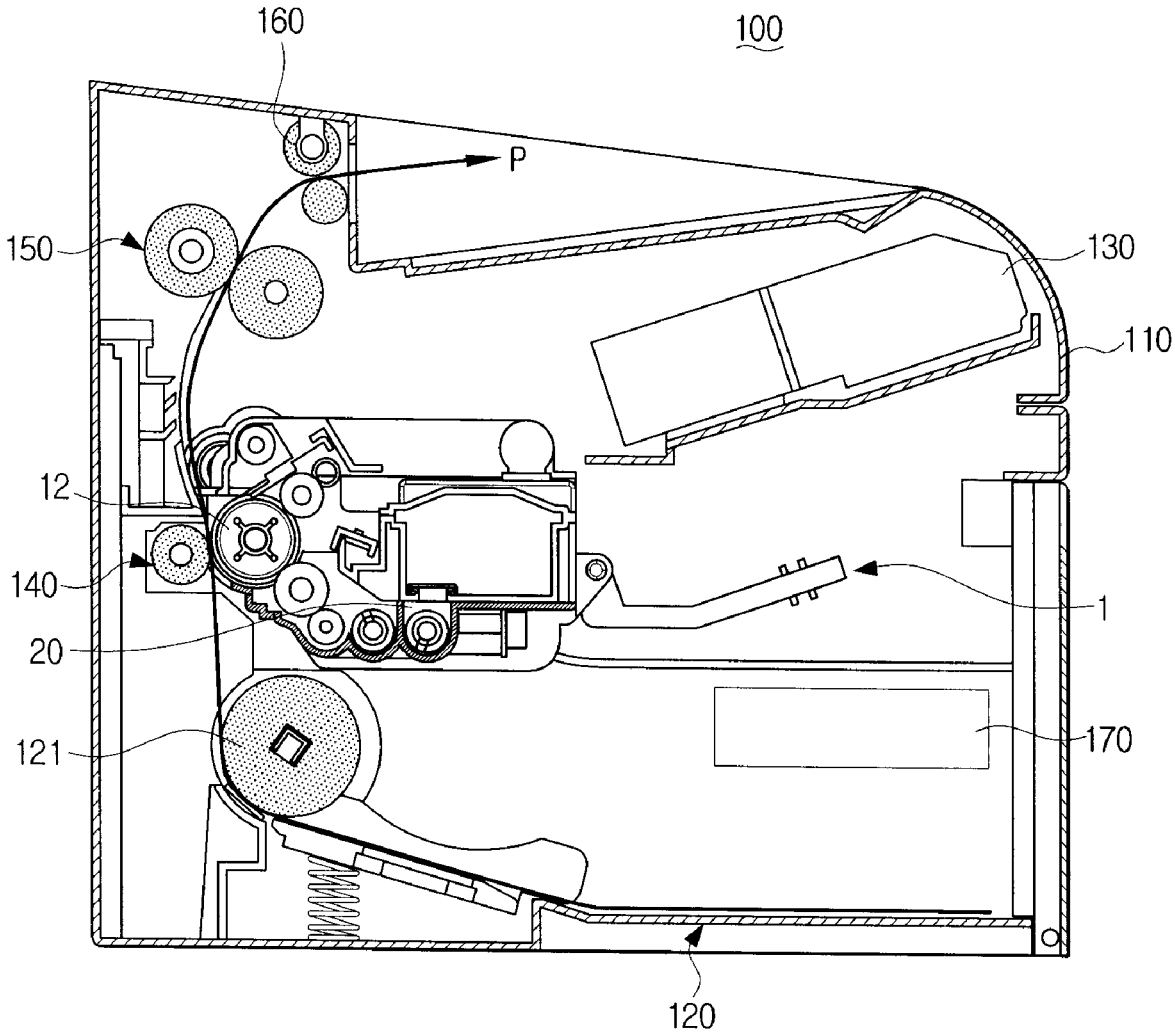
FIG. 3 is a sectional view schematically illustrating an image forming apparatus, in which the developing cartridge of FIG. 1 is mounted.

In an embodiment, the image carrier 12 is rotatably disposed in the front portion of the housing 11 alternatively, the image carrier 12 may be provided separately outside the housing 11. An opening 15 through which a portion of the image carrier 12 is exposed may be formed at the housing 11 in front of the image carrier 12. When the developing cartridge 1 is mounted into the image forming apparatus 100, as illustrated in FIG. 3, the image carrier 12 may face a transfer roller 140 via the opening 15.

Image carrier-cleaning unit 16 for removing waste developer remaining on the image carrier 12, and charging roller 17 for charging the surface of the image carrier 12 may also be disposed above the image carrier 12. In this embodiment, the image carrier 12 is disposed integrally with the developing cartridge 1. Alternatively, the image carrier 12 (as well as the image carrier-cleaning unit 16 and/or charging roller 17) may be disposed in the image forming apparatus 100 separately from the developing cartridge 1.

The developing member 13 supplies the image carrier 12 with developer from the developer-storing portion 20. In this embodiment, a developing roller is used as the developing member 13. The developing roller 13 is rotatably disposed in the housing 11 nearby the image carrier 12. A developer-supplying roller 14 may be disposed between the developing roller 13 and the developer-storing portion 20.

The developer-storing portion 20 is formed inside the housing 11 to store a predetermined amount of developer. The developer-storing portion 20 may store an amount of developer sufficient for printing a number of sheets of printing media. For example, the developer-storing portion 20 may store enough amount of developer for printing, e.g., approximately 1000 pages of A4 paper at, e.g., 5% print coverage. Because the developing cartridge 1 usable with the image forming apparatus according to an embodiment has a predetermined amount of developer in the developer-storing portion 20, even when the developing cartridge 1 has no developer cartridge 50 installed therein (see FIG. 1), it can still perform normal printing operations.

For the sake of clarity, during manufacturing of the developing cartridges, for the purpose of quality verification, few test printing operations may be performed by the manufacturer of the developing cartridge by supplying the developing cartridge with a small amount of developer, which may be referred to as a pre-charged developer. The amount of the pre-charged developer may be sufficient to print approximately 5~30 sheets of A4 size paper at, e.g., 5% print coverage. These test printing operations performed under manufacturing testing environment, however, are not to be considered "normal printing operations" for the purpose of the present description as they are not part of the normal usage intended for a consumer user.

At least one supply developer-conveying member 21 and 22 may be disposed in the developer-storing portion 20 of the developing cartridge 1 to convey and/or circulate the developer stored in the developer-storing portion 20. In this embodiment, as illustrated in FIG. 2, two supply developer-conveying members 21 and 22 are disposed side by side in the developer-storing portion 20. A helical roller or screw may be used as either or both of the supply developer-conveying member 21 and 22.

The mounting portion 30 is formed above the developer-storing portion 20 in the housing 11. The mounting portion 30 may be formed in various shapes as long as the mounting portion 30 can allow the developer cartridge 50 to be fixed to the developing cartridge 1. In this embodiment, the mounting portion 30 is formed substantially as a cavity or chamber that extends inwardly from an outer surface of the housing 11. As illustrated in FIG. 1, an entrance 30*a* of the mounting portion 30 is formed at the surface of the housing 11 such that the developer cartridge 50 can be mounted parallel with the developing roller 13. A power-transmitting member (not illustrated) to rotate a discharge developer-conveying member 53 (see FIG. 6) of the developer cartridge 50 may be disposed at a bottom of the mounting portion 30.

A connecting member 31 may be disposed on the bottom surface of the mounting portion 30 adjacent to the developer-storing portion 20. The connecting member 31 fluidly communicates the developer-storing portion 20 with the developer cartridge 50. Therefore, when the developer cartridge 50 is mounted into the mounting portion 30 of the developing cartridge 1, an outlet 55 (see FIG. 6) of the developer cartridge 50 is in fluid communication with the connecting member 31. The connecting member 31 may be configured so that when no developer cartridge 50 is mounted into the developing cartridge 1, the connecting member 31 is closed, and when the developer cartridge 50 is mounted into the developing cartridge 1, the connecting member 31 is open. Structure with which the developer cartridge 50 may cause the connecting member 31 to be opened and closed are well-known, and the detailed description thereof is unnecessary.

One or more mounting guiding groove 32*a* and 32*b* may be formed in the mounting portion 30 of the developing cartridge 1 to guide the developer cartridge 50 to be mounted. Furthermore, the developer cartridge 50 may have one or more mounting guide 59*a* and 59*b* corresponding to the mounting guiding groove 32*a* and 32*b* formed in the mounting portion 30. In this embodiment, as illustrated in FIGS. 1 and 2, two mounting guiding grooves 32*a* and 32*b* are formed on opposite sides of the mounting portion 30 and the developer cartridge 50 has two mounting guides 59*a* and 59*b* corresponding to the two mounting guiding grooves 32*a* and 32*b*.

FIG. 3 is a sectional view schematically illustrating the image forming apparatus 100 in which the developing cartridge 1 according to an embodiment of aspects of the present invention is mounted.

Referring to FIG. 3, the image forming apparatus 100 according to an embodiment may include a main casing 110, a printing medium feeding unit 120, an exposure unit 130, the developing cartridge 1, the transfer roller 130, a fixing unit 150, a discharging roller 160, and a controller 170.

The main casing 110 defines the outer appearance of the image forming apparatus 100, and may house and support the printing medium feeding unit 120, the exposure unit 130, the developing cartridge 1, the transfer roller 140, the fixing unit 150, the discharging roller 160, and the controller 170.

The printing medium feeding unit 120 stores printing media P, and picks up the printing media P one by one to feed the printing medium P to the developing cartridge 1. A pickup roller 121 is disposed at a leading end of the printing medium feeding unit 120.

The exposure unit 130 may emit light, e.g., a laser beam, corresponding to print data to form electrostatic latent images on the image carrier 12, which may be provided in the developing cartridge 1.

The developing cartridge 1 stores a quantity of developer, and develops the electrostatic latent images formed on the image carrier 12 into visible developer images. The developing cartridge 1 may be detachably mounted into the main casing 110. When the developing cartridge 1 is mounted into the main casing 110, the developing cartridge 1 receives a motional power from a driving apparatus (not illustrated) disposed inside the main casing 110 so that the image carrier 12, the developing roller 13, and the supply developer-conveying members 21 and 22 may operationally move, e.g., rotate. The structure and operation of the developing cartridge 1 are described above; therefore, detailed descriptions thereof will not be repeated.

The transfer roller 140 causes the visible developer images formed on the image carrier 12 to be transferred onto the printing media P.

The fixing unit 150 causes the developer images transferred onto the printing media P to be fixed onto the printing medium P. The discharging roller 160 discharges the printing media P having the developer images fixed thereon out of the image forming apparatus 100.

After the developing cartridge 1 is mounted to the main casing 110, the controller 170 uses the first mounting history indicating member 40 of the developing cartridge 1 to determine whether the mounted developing cartridge 1 is a new one, i.e., which has not previously been used, or a used one. If the developing cartridge 1 is a new one, the controller 170 remembers the number of pages that can be printed by using the developer stored in the developer-storing portion 20 as the total number of pages that can be printed. The controller 170 may additionally determine whether the developer cartridge 50 is mounted into the developing cartridge 1. When the developer cartridge 50 is mounted into the developing cartridge 1, the controller 170 adds the number of pages that can be printed by using the supplementary developer stored in the developer cartridge 50, setting the combined number of pages as the total number of pages that can be printed. That is, when the developer cartridge 50 is mounted into the developing cartridge 1, the controller 170 adds the first number of pages that can be printed by using the developer stored in the developer-storing portion 20 of the developing cartridge 1 to the second number of pages that can be printed by using the supplementary developer stored in the developer cartridge 50 to get the sum thereof, and then, remembers the sum as the total number of pages that can be printed.

The controller 170 may also control various components of the image forming apparatus, e.g., one or more of the printing medium feeding unit 120, the exposure unit 130, the developing cartridge 1, the transfer roller 140, the fixing unit 150, and the discharging roller 160, to control the printing operations. To this end, according to an embodiment, the the controller 170 may be, e.g., a microprocessor, a microcontroller or the like, that includes a CPU to execute one or more computer instructions to implement the various control operations herein described, and may further include a memory device, e.g., a Random Access Memory (RAM), Read-Only-Memory (ROM), a flesh memory, or the like, to store the one or more computer instructions. The method in which the controller 170 controls the above-described elements to perform a printing operation is similar to that of well-known image forming apparatuses; detailed description thereof is thus unnecessary.

Operations and printing processes of the developing cartridge 1 usable with an image forming apparatus according to an embodiment will be further explained below with reference to FIGS. 1 to 3.

After the developing cartridge 1 is mounted into the main casing 110, the controller 170 determines whether the developing cartridge 1 is a new one by using the first mounting history indicating member 40. When the mounted developing cartridge 1 is a new one, the controller 170 reads the number of pages that can be printed corresponding to the mounted developing cartridge 1 previously stored in a memory (not illustrated), and sets the number of pages as the total number of pages that can be printed. In one embodiment, the number of pages that can be printed may be based on the amount of developer stored in the developer-storing portion 20 of the developing cartridge 1. On the other hand, if the developing cartridge 1 mounted into the main casing 110 is determined to be used, the controller 170 may determine the number of pages to be printed taking into account the number of pages that the image forming apparatus 100 has printed by the time the developing cartridge 1 is mounted. Accordingly, the controller 170 is capable to determine whether the number of pages to be printed reaches the number of pages that can be printed by using the mounted developing cartridge 1.

When a new developing cartridge 1 is mounted into the main casing 110 of the image forming apparatus 100, the controller 170 may perform an operation on the first mounting history indicating member 40 in order to recognize when the same developing cartridge 1 is later separated and remounted after the initial mounting. For example, in an embodiment, in which a fuse is used as the first mounting history indicating member 40, when a new developing cartridge 1 is mounted into the case 110, the controller 170 may sense current flowing through the fuse, and make the determination that the mounted developing cartridge 1 is new, and then, may apply a sufficient amount of current to blow the fuse. Accordingly, when the same developing cartridge 1 is remounted into the image forming apparatus 100, the controller 170 may recognize the mounted developing cartridge 1 is not new by the fact that no current flows in the fuse. As a result, when a used developing cartridge 1 is mounted, the controller 170 can determine that the mounted developing cartridge 1 has already been used. The controller 170 may then determine the number of pages that can be printed based on whether the mounted developing cartridge 1 is new or used.

When a print command or instruction is received, the controller 170 of the image forming apparatus 100 may control the exposure unit 130 to emit a laser beam to form electrostatic latent images corresponding to the printing data on the image carrier 12 of the developing cartridge 1.

The supply developer-conveying members 21 and 22 in the developing cartridge 1, e.g., with their rotations, feed the developer stored in the developer-storing portion 20 to the developing roller 13. The developing roller 13 of the developing cartridge 1 supplies the developer to the image carrier 12 to develop the electrostatic latent images into visible developer images. Because the developing cartridge 1 according to an embodiment may have an amount of developer in the developer-storing portion 20 thereof, even when the developer cartridge 50 is not mounted to the developing cartridge 1, the developing cartridge 1 can still develop the electrostatic latent images on the image carrier 12.

The controller 170 may also control the printing medium feeding unit 120 to pick up and feed a printing medium P between the transfer roller 140 and the image carrier 12 of the developing cartridge 1. Then, the developer images may be transferred from the image carrier 12 onto the printing medium P.

While the printing medium P having the developer images transferred thereon passes through the fixing unit 150, the developer images transferred onto the printing medium P are fixed onto the printing medium P. Then, the discharging roller 160 discharges the printing medium P out of the image forming apparatus 100.

While performing the printing operation, the controller 170 of the image forming apparatus 100 may keep track of the number of printed pages that has been printed. The controller 170 may continue to perform the printing operations until the number of printed pages reaches the total number of pages that can be printed.

As described above, with the developing cartridge 1 usable with an image forming apparatus according to an embodiment of the present invention, even when the developing cartridge 1 with no developer cartridge 50 is mounted, the image forming apparatus 100 may be operable, and may print up to a number of pages.

When the number of printed pages reaches the total number of pages that can be printed, the controller 170 of the image forming apparatus 100 may alert the fact that the developer supply has been exhausted. A user upon being so alerted may separate the developing cartridge 1 from the image forming apparatus 100, mount a developer cartridge 50 into the mounting portion 30 of the developing cartridge 1, and then reinstall the developing cartridge 1 with the developer cartridge 50 in the image forming apparatus 100.

Figure 4:
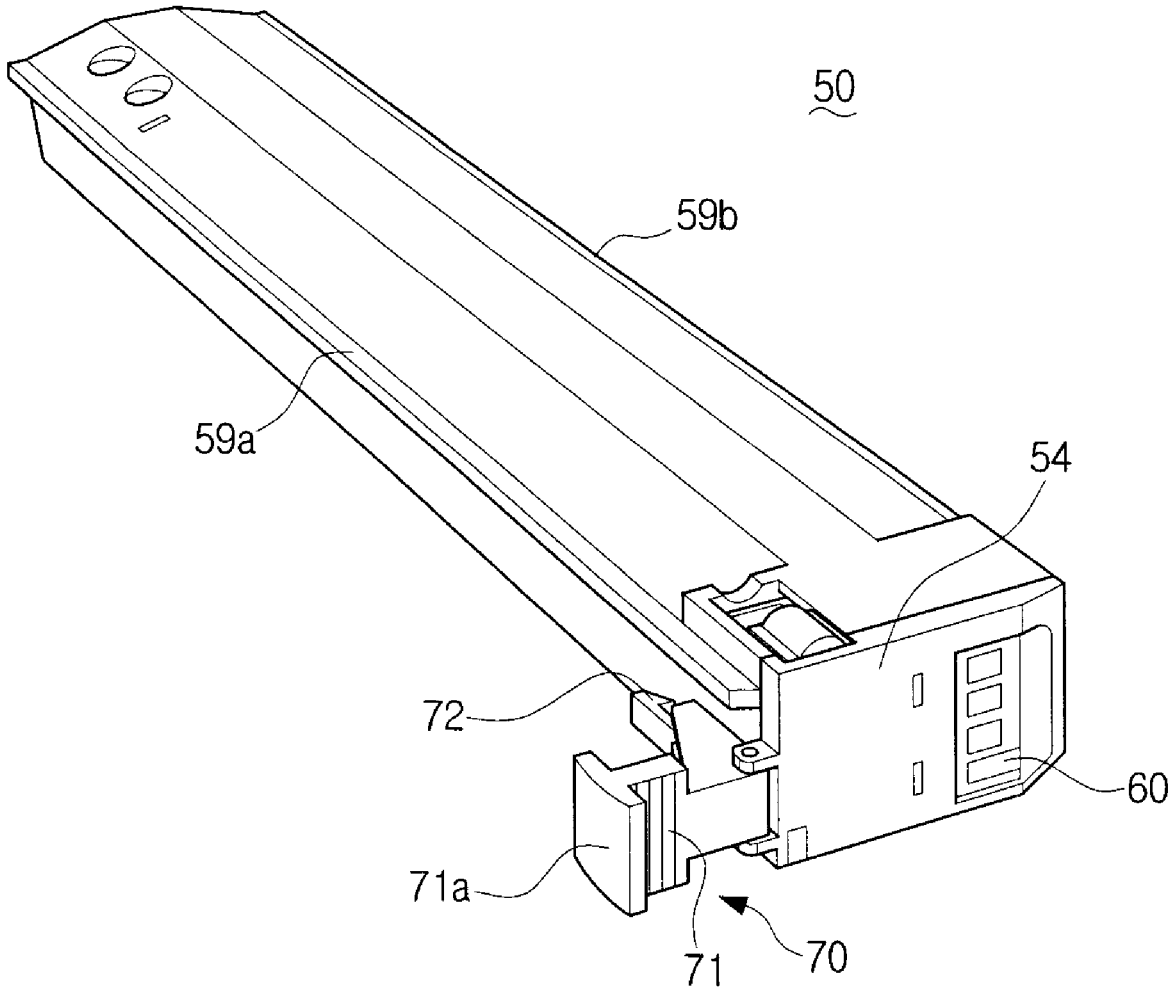
FIG. 4 is a perspective view illustrating a developer cartridge capable of being mounted to the developing cartridge of FIG. 1.
Figure 5:
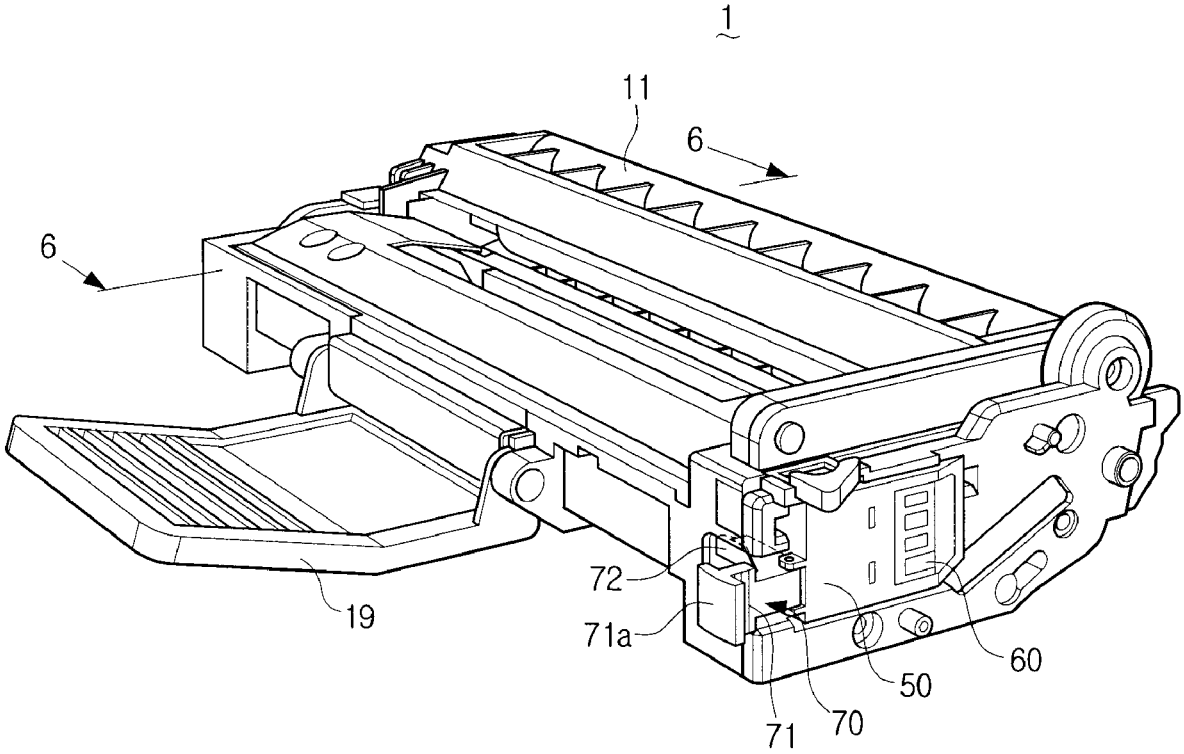
FIG. 5 is a perspective view illustrating a developing cartridge usable with an image forming apparatus according to an embodiment of the present invention, to which the developer cartridge of FIG. 4 is mounted.
Figure 6:
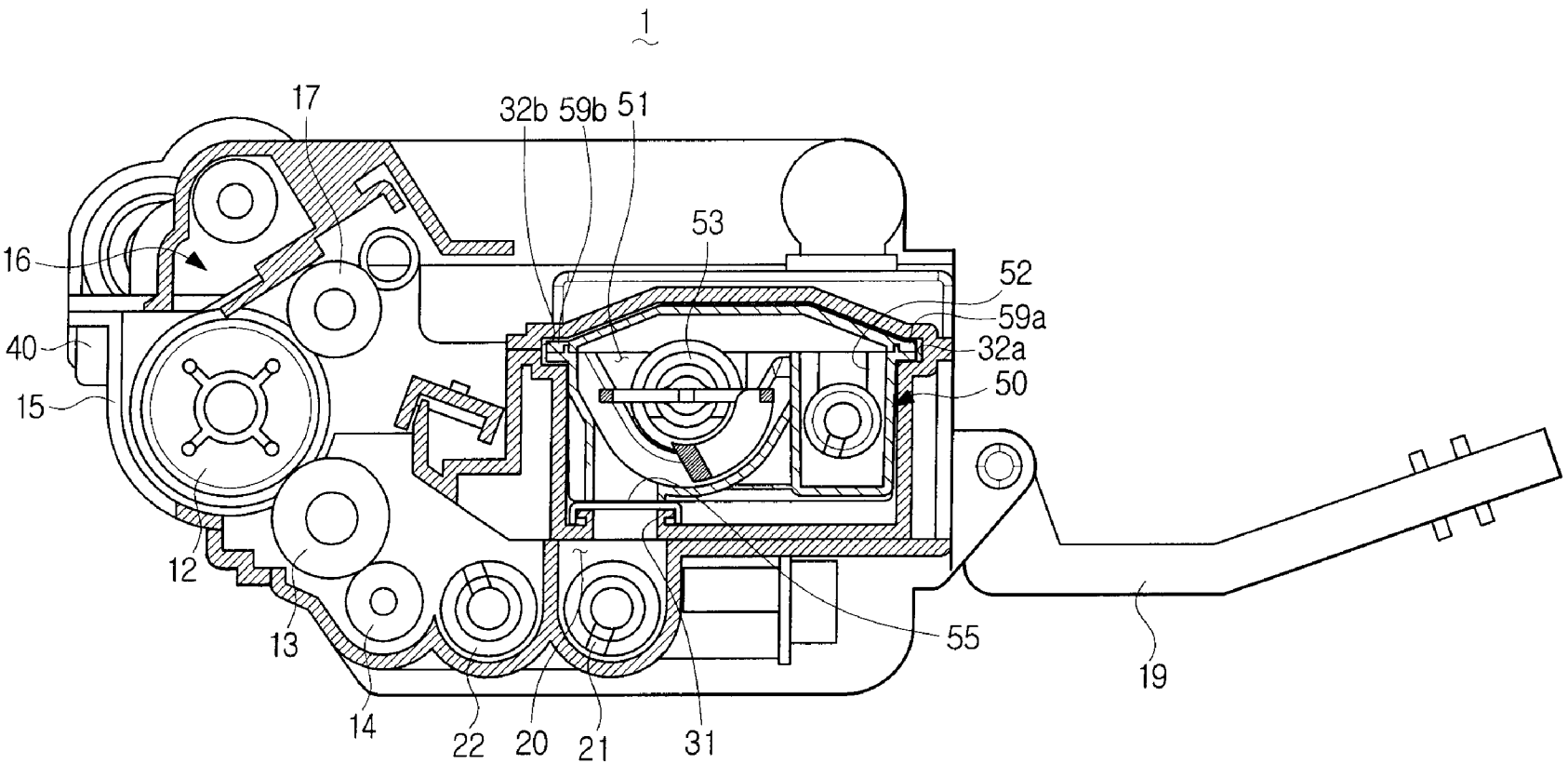
FIG. 6 is a sectional view illustrating the developing cartridge of FIG. 5 taken along the line 6-6 shown in FIG. 5.

FIG. 4 is a perspective view illustrating the developer cartridge 50 capable of being mounted to the developing cartridge 1 according to an embodiment. FIG. 5 is a perspective view illustrating the developing cartridge 1 usable with an image forming apparatus according to an embodiment, to which the developer cartridge 50 of FIG. 4 is mounted. FIG. 6 is a sectional view illustrating the developing cartridge 1 of FIG. 5.

Referring to FIGS. 4 to 6, in this example, the developer cartridge 50 is formed substantially in a rectangular parallelepiped shape. A developer-receiving portion 51 in which a predetermined amount of supplementary developer is stored is formed inside the developer cartridge 50. The discharge developer-conveying member 53 may be rotatably disposed in the developer-receiving portion 51.

According to an embodiment, the developer-receiving portion 51 may be formed to store the amount of developer more than the amount of developer stored in the developer-storing portion 20 of the developing cartridge 1. For example, when the developer-storing portion 20 of the developing cartridge 1 stores the amount of developer capable of normally printing approximately 1000 pages of A4 paper at 5% average print coverage, the developer-receiving portion 51 of the developer cartridge 50 may be formed to store an amount of developer capable of printing approximately 2000~3000 pages of A4 paper at 5% average print coverage.

The developer cartridge 50 may be formed to be mounted into the developing cartridge 1 parallel with the lengthwise direction of the developing cartridge 1 or with the lengthwise direction of the developing roller 13. This structure and mounting direction may allow developer leakage to be minimized during mounting and removal of the developer cartridge 50 to and from the developing cartridge 1.

The developer cartridge 50 may include one or more mounting guides 59*a* and 59*b* for mounting of the developer cartridge 50. In this embodiment illustrated in FIG. 4, the developer cartridge 50 has two mounting guides 59*a* and 59*b* disposed along the length of the developer cartridge 50. When mounting the developer cartridge 50 into the developing cartridge 1, the two mounting guides 59*a* and 59*b* cooperate with the two mounting guiding grooves 32*a* and 32*b* formed in the mounting portion 30 of the developing cartridge 1, and thereby, when the developer cartridge 50 is pushed into the interior of the mounting portion 30, guide the developer cartridge 50 into the mounted position. Thus, the developer cartridge 50 may be mounted in the developing cartridge 1.

The mounting portion 30 of the developing cartridge 1 into which the developer cartridge 50 is mounted may be formed substantially as a cavity or recess extending from the outer surface of the housing 11 into the interior of the developing cartridge 1, and may be formed such manner to allow the user to readily see the mounting location of the developer cartridge 50. The mounting guiding grooves 32*a* and 32*b* of the mounting portion 30 of the developing cartridge 1 guide the developer cartridge 50 during the mounting of the developer cartridge 50 so that the mounting the developer cartridge 50 into the developing cartridge 1 may be easier.

A helical shaped screw or roller may be used as the discharge developer-conveying member 53. According to an embodiment, a waste developer-receiving portion 52 may be provided at adjacent to and parallel with the developer-receiving portion 51 (see FIG. 6). The waste developer-receiving portion 52 may receive waste developer removed from the image carrier 12 by the image carrier-cleaning unit 16.

An outlet 55 may be formed on the bottom surface of the developer cartridge 50. The developer stored in the developer-receiving portion 51 may be moved toward the outlet 55 by the discharge developer-conveying member 53, which may be then is discharged out of the developer cartridge 50 through the outlet 55. The outlet 55 may be configured so that when the developer cartridge 50 is mounted into the developing cartridge 1, the outlet 55 is opened by the connecting member 31 of the developing cartridge 1, and when the developer cartridge 50 is separated from the developing cartridge 1, the outlet 55 is closed. Accordingly, when the developer cartridge 50 is mounted into the mounting portion 30 of the developing cartridge 1, the outlet 55 of the developer cartridge 50 is in fluid communication with the connecting member 31 of the developing cartridge 1.

A second mounting history indicating member 60 may also be disposed at a side of the developer cartridge 50 so that the controller 170 of the image forming apparatus 100 can determine whether the developer cartridge 50 is mounted in the developing cartridge 1. In this embodiment, as illustrated in FIG. 4, the second mounting history indicating member 60 is disposed on a side surface 54 of the developer cartridge 50 that is exposed outside when the developer cartridge 50 is mounted into the developing cartridge 1. The second mounting history indicating member 60 may use any proper device that can allow the controller 170 of the image forming apparatus 100 to detect the developer cartridge 50 mounted to the developing cartridge 1. For example, an electrode plate may be used as the second mounting history indicating member 60, and the controller 170 of the image forming apparatus 100 may have a sensor capable of sensing the electrode plate.

Furthermore, as illustrated in FIG. 4, a locking unit 70 to lock the developer cartridge 50 to the developing cartridge 1 may be disposed at the side surface 54 of the developer cartridge 50 that is exposed outside when the developer cartridge 50 is mounted into the developing cartridge 1. The locking unit 70, as illustrated in FIG. 4, may be rotatably hinged to a corner of the side surface 54 of the developer cartridge 50, and includes a locking portion 72 and a handle 71.

The locking portion 72 may be formed to be hooked on a locking projection 73 formed on the developing cartridge 1. The locking projection 73, as illustrated in FIG. 1, may project from the surface of a groove 30*b* formed in a side of the entrance 30*a* of the mounting portion 30 of the developing cartridge 1. The handle 71 may be formed to be angled approximately 90 degrees with respect to the locking portion 72 so that the user can grab the handle 71 and rotate the locking portion 72. Therefore, when the user rotates the handle 71 in a direction, the locking portion 72 hooks onto the locking projection 73 so that the developer cartridge 50 is locked in place in the developing cartridge 1. Also, when the user rotates the handle 71 in the opposite direction, the locking portion 72 is removed from the locking projection 73 of the developing cartridge 1 so that the developer cartridge 50 can be released from the developing cartridge 1.

An end of the handle 71 may be formed in a bent portion 71*a* so that the user can easily grab the handle 71. Also, the handle 71 may be formed of a color material different from the developer cartridge 50 so that when replacing the developer cartridge 50, the user can easily see the locking unit 70.

Figure 7:
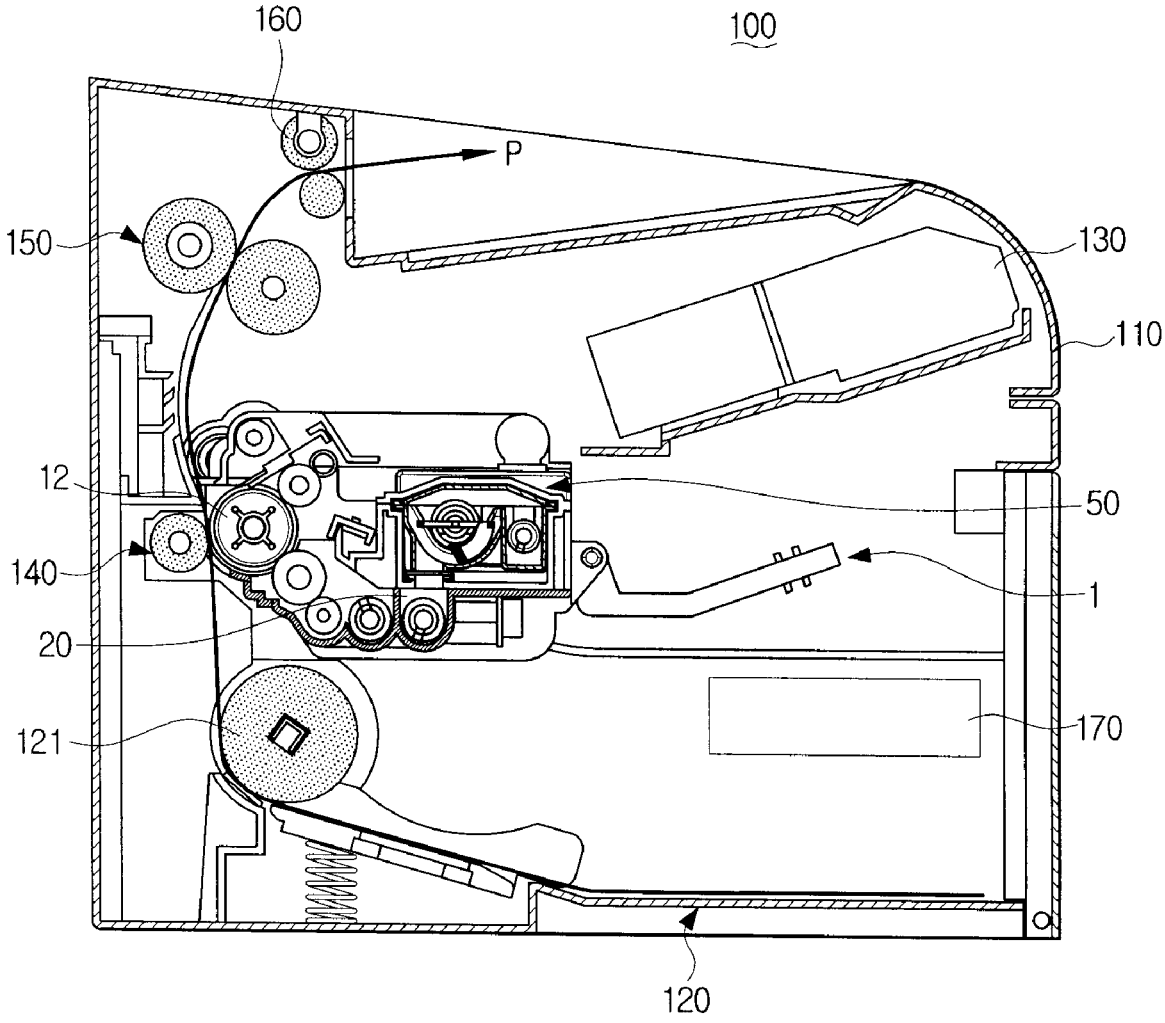
FIG. 7 is a sectional view schematically illustrating an image forming apparatus, to which the developing cartridge of FIG. 5 is mounted.

FIG. 7 is a sectional view schematically illustrating the image forming apparatus 100 into which the developing cartridge 1 according to an exemplary embodiment of the present general inventive concept with the developer cartridge 50 of FIG. 4 is mounted.

Referring to FIG. 7, the image forming apparatus 100 according to an embodiment may include the main casing 110, the printing medium feeding unit 120, the exposure unit 130, the developing cartridge 1, the transfer roller 140, the fixing unit 150, the discharging roller 160, and the controller 170.

The image forming apparatus 100 illustrated in FIG. 7 is substantially the same as the image forming apparatus 100 illustrated in FIG. 3 as described above except that the developer cartridge 50 is mounted into the developing cartridge 1. Therefore, detailed descriptions of relevant components already described are unnecessary.

Hereinafter, operations and printing processes of the developing cartridge 1 usable with an image forming apparatus according to an will be explained with reference to FIGS. 4 to 7.

After the developing cartridge 1 into which the developer cartridge 50 is mounted is mounted into the main casing 110, the controller 170 of the image forming apparatus 100 determines whether the developing cartridge 1 is a new one by using the first mounting history indicating member 40 and whether the developer cartridge 50 is mounted into the developing cartridge 1 by using the second mounting history indicating member 60. When the mounted developing cartridge 1 has the developer cartridge 50 installed therein, the controller 170 reads the number of pages that can be printed corresponding to the developer cartridge 50 mounted into the developing cartridge 1 from a memory (not illustrated), and adds the number of pages corresponding to the developer cartridge 50 to the number of pages that can be printed, and sets the sum as the total number of pages that can be printed. The memory stores the number of pages that can be printed by using the supplementary developer stored in the developer-receiving portion 51 of the developer cartridge 50. Accordingly, for example, if the image forming apparatus 100 has already printed a number of pages corresponding to the amount of developer in the developing cartridge 1, the controller 170 may set only the number of pages corresponding to the amount of the supplementary developer stored in the developer cartridge 50 as the total number of pages that can be printed.

When a print command or instruction is received, the controller 170 of the image forming apparatus 100 may control the exposure unit 130 to emit a laser beam to form electrostatic latent images corresponding to the printing data on the image carrier 12 of the developing cartridge 1.

When the developing cartridge 1 is mounted into the image forming apparatus 100, the discharge developer-conveying member 53 of the developer cartridge 50 receives a rotational power from the driving apparatus (not illustrated) disposed in the image forming apparatus 100, and rotates. When the discharge developer-conveying member 53 of the developer cartridge 50 rotates, the supplementary developer stored in the developer-receiving portion 51 of the developer cartridge 50 is moved toward the outlet 55, and is discharged therethrough. The developer discharged from the outlet 55 of the developer cartridge 50 enters the developer-storing portion 20 of the developing cartridge 1 through the connecting member 31.

The two supply developer-conveying members 21 and 22 disposed in the developing cartridge 1 rotate to supply the developing roller 13 with the developer entering the developer-storing portion 20. The developing roller 13 of the developing cartridge 1 supplies the developer to the image carrier 12 to develop the electrostatic latent images into developer images. The developing cartridge 1 according to an embodiment can receive the supplementary developer from the developer cartridge 50 mounted to the mounting portion 30 so that even when the developer stored in the developer-storing portion 20 of the developing cartridge 1 runs out, the developing cartridge 1 is able to develop the electrostatic latent images on the image carrier 12 into the developer images.

The controller 170 may control the printing medium feeding unit 120 to pick up and feed a printing medium P between the transfer roller 140 and the image carrier 12 of the developing cartridge 1. Then, the developer image is transferred from the image carrier 12 to the printing medium P.

While the printing medium P having the developer images transferred thereon passes through the fixing unit 150, the developer image is fixed onto the printing medium P. Then, the discharging roller 160 discharges the printing medium P out of the image forming apparatus 100.

While performing the printing operation, the controller 170 of the image forming apparatus 100 may continue to count the number of printed pages. The controller 170 keeps performing the printing operation until the number of printed pages reaches the total number of pages that can be printed.

As described above, with the developing cartridge 1 usable with an image forming apparatus according to an embodiment, although the developer stored in the developing cartridge 1 is completely consumed, when the developer cartridge 50 is mounted, the developing cartridge 1 can be supplied with the supplementary developer from the developer cartridge 50, and can print a number of pages.

In the above description, after the developer stored in the developing cartridge 1 is completely consumed, the developer cartridge 50 having the supplementary developer is mounted into the developing cartridge 1. However, this does not limit the timing of the developer cartridge 50 being mounted into the developing cartridge 1. For example, after a developer cartridge 50 is mounted into a new developing cartridge 1, the new developing cartridge 1 having the developer cartridge 50 may be disposed in the image forming apparatus 100. Also, a new developing cartridge 1 with no developer cartridge 50 is mounted into the image forming apparatus 100, and then the new developing cartridge 1 may be separated from the image forming apparatus 100 before the developer stored in the developing cartridge 1 is completely consumed. Then, a developer cartridge 50 is mounted into the separated developing cartridge 1, and then the developing cartridge 1 with the developer cartridge 50 again may be disposed in the image forming apparatus 100.

Figure 8:
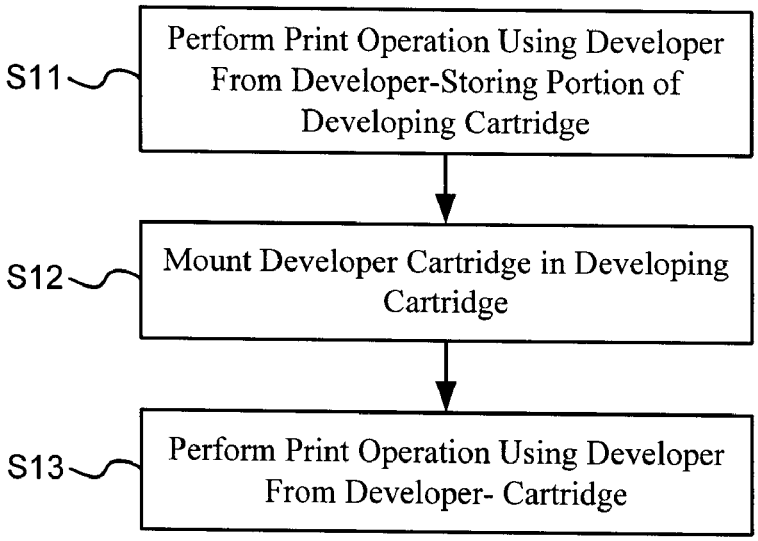
FIG. 8 is a flowchart illustrating a printing method that can be practiced in an image forming apparatus according to an embodiment of the present invention.
Figure 9:
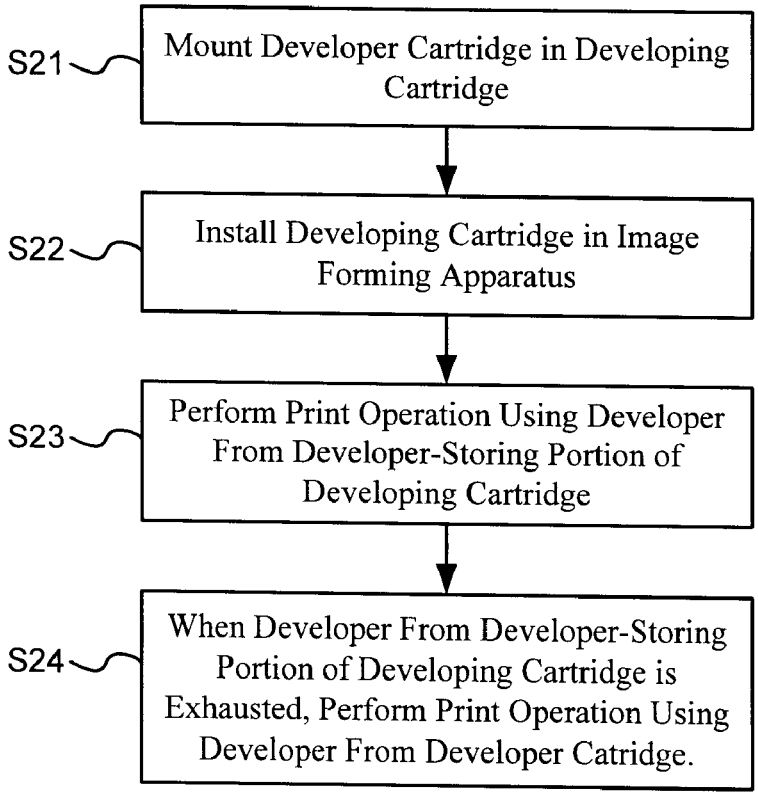
FIG. 9 is a flowchart illustrating another printing method that may be practiced in an image forming apparatus according to an embodiment of the present invention.

FIGS. 8 and 9 are flowcharts illustrating printing methods that may be practiced in an image forming apparatus 100 according to an embodiment of the present invention.

FIG. 8 illustrates a method that may be implemented using the image forming apparatus 100 when the developing cartridge 1 with no developer cartridge 50 is mounted into the image forming apparatus 100 as illustrated in FIG. 3.

Referring to FIG. 8, the image forming apparatus 100 uses the developer stored in the developer-storing portion 20 of the developing cartridge 1 with no developer cartridge 50 to perform a printing operation (S11). Then, the user separates the developing cartridge 1 from the image forming apparatus 100, and mounts a developer cartridge 50 into the separated developing cartridge 1 (S12). At this time, as illustrated in FIG. 5, the user uses the locking unit 70 to lock the developer cartridge 50 to the developing cartridge 1. After that, the user again mounts the developing cartridge 1 in which the developer cartridge 50 is mounted into the image forming apparatus 100. Then, the image forming apparatus 100 uses the developer stored in the developer cartridge 50 to perform a printing operation (S13).

FIG. 9 illustrates a method that may be implemented using the image forming apparatus 100 when the developing cartridge 1 with a developer cartridge 50, as illustrated in FIG. 7, is mounted into the image forming apparatus 100.

First, the user mounts the developer cartridge 50 into the developing cartridge 1 (S21). At this time, the user, as illustrated in FIG. 5, uses the locking unit 70 to lock the developer cartridge 50 to the developing cartridge 1. After that, the user mounts the developing cartridge 1 into which the developer cartridge 50 is mounted into the image forming apparatus 100 (S22). Then, the image forming apparatus 100 performs a printing operation using the developer stored in the developer-storing portion 20 of the developing cartridge 1 (S23). When the printing operation is continued and the developer stored in the developer-storing portion 20 of the developing cartridge 1 is completely consumed, the image forming apparatus 100 performs the printing operation using the developer stored in the developer cartridge 50 (S24).

When the developer in the developer cartridge 50 is completely consumed during the printing operation, the user separates the developing cartridge 1 from the image forming apparatus 100. The empty developer cartridge 50 is separated from the separated developing cartridge 1, and is replaced with a new developer cartridge 50. To do so, the user rotates the handle 71 of the locking unit 70 locking the developer cartridge 50, as illustrated in FIG. 5, so that the locking portion 72 of the locking unit 70 is disengaged from the locking projection 73, allowing the developer cartridge 50 to be separated from the developing cartridge 1. Then, the user mounts a new developer cartridge 50 into the developing cartridge 1, and locks the new developer cartridge 50 to the developing cartridge 1 using the locking unit 70. Then, when the developing cartridge 1, into which the new developer cartridge 50 is mounted, is installed in the image forming apparatus 100, the image forming apparatus 100 continues to perform a printing operation.

Accordingly, the developing cartridge 1 according to an exemplary embodiment of the present general inventive concept can be sold in a state that the developer cartridge 50 is mounted into the developing cartridge 1. That is, only developing cartridge 1 can be sold separately from the developer cartridge 50 differently from the conventional developing cartridge. When the developer stored in the developing cartridge 1 is completely consumed, the user can buy a new developer cartridge 50, which is sold separately from the developing cartridge 1, and mount the new developer cartridge 50 into the used developing cartridge 1 to continue to use the used developing cartridge 1.

Although a few exemplary embodiments have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing cartridge usable with an image forming apparatus, comprising:

a developing member supported in a housing of the developing cartridge, the developing member being configured to develop an electrostatic latent image into a visible developer image;

a mounting portion formed in the housing, the mounting portion being configured to accommodate therein a removable developer cartridge containing a supplemental amount of developer; and a developer storing portion provided in the housing, the developer storing portion being configured to store a first quantity of developer, the developing cartridge being configured to supply the developing member with developer from the first quantity of developer even when the removable developer cartridge is not mounted in the mounting portion.

2. The developing cartridge of claim 1, further comprising:

a connecting member formed in the housing, the connecting member being configured to define a fluid communication path between the developer storing portion and the mounting portion such that, when the removable developer cartridge is mounted in the mounting portion, the supplemental amount of developer can be received into the developer storing portion from the removable developer cartridge through the connecting member.

3. The developing cartridge of claim 1, wherein the mounting portion extends inwardly into the housing parallel to the developing member.

4. The developing cartridge of claim 3, wherein the mounting portion comprises;

at least one mounting guiding groove for guiding the removable developer cartridge during mounting of the removable developer cartridge into the mounting portion.

5. The developing cartridge of claim 3, further comprising;

a locking projection formed on the housing adjacent the mounting portion, the locking projection being configured to cooperate with a locking unit of the removable developer cartridge to lock the removable developer cartridge in place when the removable developer cartridge is mounted in the mounting portion.

6. The developing cartridge of claim 2, wherein the connecting member comprises;

a cover disposed to close the connecting member, the cover being configured to be in an interfering contact with at least a portion of the removable developer cartridge when the removable developer cartridge is mounted in the mounting portion such that the cover becomes open, and the cover being released from the interfering contact when the removable developer cartridge is removed from the mounting portion such that the cover becomes closed.

7. The developing cartridge of claim 1, further comprising;

a first mounting history indicating member having a characteristic state that is capable of being changed to indicate whether the developing cartridge had been mounted previously.

8. The developing cartridge of claim 7, wherein;

the first mounting history indicating member comprises an electrical fuse capable of being blown out when subjected to an amount of current.

9. The developing cartridge of claim 7, wherein the removable developer cartridge is mounted in the mounting portion, and the removable developer cartridge comprises:

a second mounting history indicating member provided on the removable developer cartridge for indicating whether the removable developer cartridge is mounted in the mounting portion.

10. The developing cartridge of claim 9, wherein;

the second mounting history indicating member comprises an electrode plate capable of being sensed by the image forming apparatus.

11. The developing cartridge of claim 9, wherein the second mounting history indicating member is disposed on a surface of the removable developer cartridge that is at least partially exposed when the removable developer cartridge is mounted in the mounting portion of the developing cartridge.

12. The developing cartridge of claim 1, further comprising;

the removable developer cartridge mounted in the mounting portion, wherein the developing cartridge is configured to supply the developing member with developer received from the removable developer cartridge when the first quantity of developer from the developer storing portion is substantially exhausted.

13. An image forming apparatus, comprising:

a photosensitive member configured to support thereon an electrostatic latent image;

a developing cartridge comprising:

a developing member supported in a housing of the developing cartridge, the developing member being configured to develop the electrostatic latent image into a visible developer image;

a mounting portion formed in the housing, the mounting portion being configured to accommodate therein a removable developer cartridge containing a supplemental amount of developer; and a developer storing portion provided in the housing, the developer storing portion being configured to store a first quantity of developer; and a controller configured to determine whether the removable developer cartridge is mounted in the mounting portion, and to cause the developing member to be supplied with developer from the first quantity of developer of the developer storing portion if it is determined that the removable developer cartridge is not mounted in the mounting portion.

14. The image forming apparatus of claim 13, wherein the controller is further configured to, if it is determined that the removable developer cartridge is mounted in the mounting portion, cause the developing member to be supplied with developer received from the removable developer cartridge when the first quantity of developer from the developer storing portion is substantially exhausted.

15. The image forming apparatus of claim 13, wherein the controller is further configured to determine a number of printing operations that can be performed in light of an amount of developer available from at least one of the developer storing portion and the removable developer cartridge.

16. The image forming apparatus of claim 13, further comprising:

a connecting member formed in the housing, the connecting member being configured to define a fluid communication path between the developer storing portion and the removable developer cartridge to allow the supplemental amount of developer can be received into the developer storing portion from the removable developer cartridge through the connecting member.

17. The image forming apparatus of claim 13, wherein the mounting portion extends inwardly into parallel to the developing member.

18. The image forming apparatus of claim 13, wherein the mounting portion comprises;

at least one mounting guiding groove for guiding the removable developer cartridge during mounting of the removable developer cartridge into the mounting portion.

19. The image forming apparatus of claim 13, further comprising;

a locking projection formed on the housing adjacent the mounting portion, the locking projection being configured to cooperate with a locking unit of the removable developer cartridge to lock the removable developer cartridge in place when the removable developer cartridge is mounted in the mounting portion.

20. The image forming apparatus of claim 16, wherein the connecting member comprises;

a cover disposed to close the connecting member, the cover being configured to be in an interfering contact with at least a portion of the removable developer cartridge when the removable developer cartridge is mounted in the mounting portion such that the cover becomes open, and the cover being released from the interfering contact when the removable developer cartridge is removed from the mounting portion such that the cover becomes closed.

21. The image forming apparatus of claim 13, further comprising;

a first mounting history indicating member having a characteristic state that is capable of being changed to indicate whether the developing cartridge had been mounted previously.

22. The image forming apparatus of claim 21, wherein the first mounting history indicating member comprises an electrical fuse capable of being blown out when subjected to an amount of current.

23. The image forming apparatus of claim 13, wherein the removable developer cartridge is mounted in the mounting portion, and the removable developer cartridge comprises:

a second mounting history indicating member provided on the removable developer cartridge for indicating whether the removable developer cartridge is mounted in the mounting portion.

24. The image forming apparatus of claim 23, wherein the second mounting history indicating member is disposed on a surface of the removable developer cartridge that is at least partially exposed when the removable developer cartridge is mounted in the mounting portion of the developing cartridge.

25. The image forming apparatus of claim 23, wherein the second mounting history indicating member comprises an electrode plate, the controller being configured to determine whether the electrode plate is present.

26. A method of controlling an image forming apparatus, comprising:

determining whether a removable developer cartridge is mounted in a developing unit of the image forming apparatus, the developing unit including a developing member configured to use developer to develop an electrostatic latent image into a visible developer image during a printing operation; and if it was determined that the removable developer cartridge is not mounted, performing a printing operation using developer available in a developer storing portion provided in the developing unit.

27. The method of controlling the image forming apparatus as set forth in claim 26, further comprising:

if it was determined that the removable developer cartridge is mounted in the developing unit, determining if there is developer available in the developer storing portion; and performing a printing operation using developer available in the developer storing portion if it is determined that there is developer available in the developer storing portion.

28. The method of controlling the image forming apparatus as set forth in claim 27, further comprising:

performing a printing operation using developer received from the removable developer cartridge if it is determined that there is no developer available in the developer storing portion.

29. The method of controlling the image forming apparatus as set forth in claim 26, further comprising:

if it was determined that the removable developer cartridge is not mounted in the developing unit, determining if there is developer available in the developer storing portion; and providing an alert message that supply of developer has been exhausted if it is determined that there is no developer available in the developer storing portion.

30. The method of controlling the image forming apparatus as set forth in claim 26, wherein the developing unit comprises a developing cartridge detachably supported in the image forming apparatus, the method further comprises:

determining whether a developing cartridge is installed in the image forming apparatus;

determining, if the developing cartridge is determined to be installed, whether the installed developing cartridge is new or used; and determining a total number of print media on which printing operation can be performed, the total number being a first number of print media that can be printed with a first quantity of developer stored in the developer storing portion provided in the developing cartridge if it is determined that a new developing cartridge is installed, to which no removable developer cartridge is mounted, and the total number being a second number of print media that can be printed with a sum of the first quantity and a second quantity of developer available in the removable developer cartridge if it is determined that a new developing cartridge is installed, to which the removable developer cartridge is mounted.

31. The method of controlling the image forming apparatus as set forth in claim 30, further comprising:

performing printing operations on the first number of print media if it was determined that a new developing cartridge is installed, to which the removable developer cartridge is not mounted; and providing an alert message that supply of developer has been exhausted after performing printing operations on the first number of print media.

32. The method of controlling the image forming apparatus as set forth in claim 30, further comprising:

performing printing operations on the second number of print media if it was determined that a new developing cartridge is installed, to which the removable developer cartridge is mounted; and providing an alert message that supply of developer has been exhausted after performing printing operations on the second number of print media.

33. A developer cartridge capable of being detachably received into a mounting portion provided in a developing cartridge detachably supported in an image forming apparatus, comprising:

a developer receiving portion formed inside the developer cartridge to store an amount of supplemental developer;

an outlet formed in the developer cartridge, the outlet, when the developer cartridge is mounted in the mounting portion of the developing cartridge, being in fluid communication with a developer storing portion of the developing cartridge, the developer storing portion providing a storage for a quantity of developer, and a developer conveying member rotatably disposed inside the developer receiving portion, the developer conveying member, when the developer cartridge is mounted in the mounting portion of the developing cartridge, being controlled by a controller of the image forming apparatus to convey the supplementary developer to the developing cartridge through the outlet after the quantity of developer stored in the developer storing portion of the developing cartridge is exhausted.

34. The developer cartridge of claim 33, further comprising:

a mounting indicating member provided on the developer cartridge for indicating whether the developer cartridge is mounted in the mounting portion.

35. The developer cartridge of claim 34, wherein the mounting indicating member is disposed on a surface of the developer cartridge that is at least partially exposed when the developer cartridge is mounted in the mounting portion of the developing cartridge.

36. The developer cartridge of claim 34, wherein the mounting indicating member comprises an electrode plate capable of being sensed by the image forming apparatus.

37. The developer cartridge of claim 33, further comprising:

a waste developer receiving portion formed in the developer cartridge adjacent the developer receiving portion, the waste developer receiving portion providing a collection space for storing waste developer received from the developing cartridge.

38. The developer cartridge of claim 33, further comprising:

at least one mounting guide formed on the developer cartridge, the at least one mounting guide being configured to correspond to and to cooperate with at least one mounting guiding groove formed in the mounting portion of the developing cartridge to guide the developer cartridge in place during mounting of the developer cartridge in the mounting portion.

39. The developer cartridge of claim 33, further comprising:

a locking unit formed on the developer cartridge, the locking unit being configured to couple with a locking projection formed on the developing cartridge to lock the developer cartridge in place in the developing cartridge.

* * * * *